US012065623B2

(12) United States Patent
Kolekar et al.

(10) Patent No.: US 12,065,623 B2
(45) **Date of Patent: *Aug. 20, 2024**

(54) LUBRICANT FOR USE IN ELECTRIC AND HYBRID VEHICLES AND METHODS OF USING THE SAME

(71) Applicant: Valvoline Licensing and Intellectual Property, LLC, Lexington, KY (US)

(72) Inventors: Anant Kolekar, Lexington, KY (US); James Brown, Lexington, KY (US); Frances Lockwood, Georgetown, KY (US); Dale Reid, Lexington, KY (US)

(73) Assignee: VGP IPCO LLC, Lexington, KY (US)

( * ) Notice: Subject to any disclaimer, the term of this patent is extended or adjusted under 35 U.S.C. 154(b) by 113 days.

This patent is subject to a terminal disclaimer.

(21) Appl. No.: 17/817,158

(22) Filed: Aug. 3, 2022

(65) Prior Publication Data

US 2022/0372393 A1 Nov. 24, 2022

Related U.S. Application Data

(63) Continuation-in-part of application No. 16/858,658, filed on Apr. 26, 2020, now Pat. No. 11,441,096.

(Continued)

(51) Int. Cl.
*C10M 135/18* (2006.01)
*C10M 169/04* (2006.01)

(Continued)

(52) U.S. Cl.
CPC ..... *C10M 135/18* (2013.01); *C10M 169/04* (2013.01); *C10M 2219/068* (2013.01);

(Continued)

(58) Field of Classification Search
CPC ..... C10M 135/18; C10M 169/04; C10M 2219/068; C10N 2010/12; C10N 2030/10;

(Continued)

(56) References Cited

U.S. PATENT DOCUMENTS 3,419,589 A 12/1968 Larson et al.
5,157,963 A 10/1992 Muyskens et al.

(Continued)

FOREIGN PATENT DOCUMENTS

CN 109233943 A 1/2019
JP 2013-082797 A 5/2013
WO 02/46744 A2 6/2002

OTHER PUBLICATIONS

De Feo, M., Minifray, C., De Barros Bouchet, M.I., Thiebaut, B., Le Mogne, T., Vacher, B., Martin, J.M., "Ageing impact on tribological properties of MoDTC-containing base oil", Tribology International, 2015, 92, 126-135 (Year: 2015).*

(Continued)

*Primary Examiner* — James C Goloboy
(74) *Attorney, Agent, or Firm* — BENESCH, FRIEDLANDER, COPLAN & ARONOFF LLP

(57) ABSTRACT

A lubricant formulation for an electric or hybrid vehicle includes a base oil, or a blend thereof, one or more additives, and a molybdenum amine complex, such as diisotridecylamine molybdate, are provided. Lubricant formulations can be characterized by one of: improving electric motor protection when a voltage is applied to an electrode in the presence of a formulation comprising the diisotridecylamine molybdate additive as compared to a fluid lacking the diisotridecylamine molybdate additive; maintaining the electrical resistance slope of a formulation comprising the diisotridecylamine molybdate additive as compared to a fluid lacking the diisotridecylamine molybdate additive; the formulation forming a protective film on copper surfaces; a change in color of the formulation indicating contact load, temperature, time, or viscosity change.

20 Claims, 10 Drawing Sheets

Related U.S. Application Data

(60) Provisional application No. 62/839,365, filed on Apr. 26, 2019.

(51) Int. Cl.

| | |
|---|---|
| ***C10N 10/12*** | (2006.01) |
| ***C10N 30/10*** | (2006.01) |
| ***C10N 30/20*** | (2006.01) |
| ***C10N 40/04*** | (2006.01) |
| ***C10N 40/14*** | (2006.01) |

(52) U.S. Cl.
CPC ..... *C10N 2010/12* (2013.01); *C10N 2030/10* (2013.01); *C10N 2030/20* (2013.01); *C10N 2040/04* (2013.01); *C10N 2040/17* (2020.05)

(58) Field of Classification Search
CPC ..... C10N 2030/20; C10N 2040/04; C10N 2040/17
See application file for complete search history.

(56) References Cited

U.S. PATENT DOCUMENTS

| | | | | |
|---|---|---|---|---|
| 5,360,561 | A | 11/1994 | Hall et al. | |
| 6,074,993 | A | 6/2000 | Waddoups et al. | |
| 6,232,276 | B1 | 5/2001 | Stiefel et al. | |
| 6,268,316 | B1 | 7/2001 | Tanaka et al. | |
| 7,112,558 | B2 | 9/2006 | Gatto | |
| 7,736,730 | B2 | 6/2010 | Jung et al. | |
| 7,845,217 | B2 | 12/2010 | Dodd | |
| 7,897,550 | B2 | 3/2011 | Kawamura et al. | |
| 8,367,591 | B2 | 2/2013 | Kamano | |
| 8,400,030 | B1 | 3/2013 | Tang | |
| 8,586,516 | B2 | 11/2013 | Milner et al. | |
| 9,778,242 | B2 | 10/2017 | Gibbons et al. | |
| 11,441,096 | B2 * | 9/2022 | Kolekar | C10M 169/04 |
| 2004/0209786 | A1 | 10/2004 | Sagawa | |
| 2006/0135374 | A1 | 6/2006 | Cooper et al. | |
| 2010/0249000 | A1 | 9/2010 | Kamano | |
| 2012/0071373 | A1 | 3/2012 | Matsui et al. | |
| 2012/0264666 | A1 | 10/2012 | Donnelly et al. | |
| 2013/0197830 | A1 | 8/2013 | Dvorak et al. | |
| 2015/0175927 | A1 | 6/2015 | Utaka et al. | |
| 2016/0024416 | A1 * | 1/2016 | Kamano | C10M 141/08 508/192 |
| 2018/0100114 | A1 | 4/2018 | Gao et al. | |
| 2018/0100115 | A1 | 4/2018 | Gao et al. | |
| 2019/0024016 | A1 | 1/2019 | Narita | |

OTHER PUBLICATIONS

Examination Report dated Oct. 30, 2023 for European Application No. 20795602.0, 7 pages.
International Search Report and Written Opinion issued in PCT application No. PCT/US2020/029997, mailing date Aug. 7, 2020.
Feo, M. De, et al., Ageing impact on tribological properties of MoDTC containing base oil, Tribology International, 2015, vol. 92, pp. 126-135.
Feo, M. De, et al., "MoDTC friction modifier additive degradation: Correlation between tribological performance and chemical changes", The Royal Society of Chemistry, 2015, vol. 5, pp. 93786-96796.
Notice of Allowance dated Apr. 10, 2023 for Korean Application No. 10-2021-7038383, 6 pages.
Extended European Search Report issued in European application No. 20795602.0, dated Sep. 12, 2022.

* cited by examiner

LUBRICANT FOR USE IN ELECTRIC AND HYBRID VEHICLES AND METHODS OF USING THE SAME

CROSS-REFERENCE TO RELATED APPLICATIONS

This application is a continuation-in-part application of U.S. application Ser. No. 16/858,658 filed on Apr. 26, 2020, entitled Lubricant for Use in Electric and Hybrid Vehicles and Methods of Using the Same, that claims priority to U.S. Provisional Application No. 62/839,365, filed on Apr. 26, 2019, entitled Specialty Lubricant for Electric and Hybrid Vehicles: Predicts Operating Conditions and Protects Yellow Metal and Electrical Breakdown. Each of these applications is incorporated herein in its entirety.

RELATED TECHNOLOGY

The disclosure relates to novel lubricants for electric and hybrid vehicles, which include improved racing gear oils for efficiency and durability, and methods of using the same.

BACKGROUND

As the competition to develop electric vehicles (EVs) intensifies, there are new demands on drive system fluids (gear oils), coolants and greases. The increased demand is because, in large part, the fluids will now be in contact with electric parts and affected by electrical current and electromagnetic fields.

Moreover, the drive system fluids, used as a motor coolant, must be compatible with copper wires and electrical parts, special plastics, and insulation materials. Electric motors generate large quantities of heat and run at higher speeds to increase efficiency, which requires an improved gear oil that can lubricate gearboxes (transmissions) and axles, while removing the heat effectively from motor and gears. In addition, higher speeds from the motor need to be converted to drivable speeds in the drive system, which puts an increase load (torque) on the gears.

Therefore, the new technology demands a considerable change in lubricant specifications. The fully formed lubricants described herein can be used in single and multi-speed transmissions in EVs.

SUMMARY

In one embodiment, a fully formed lubricant is formulated with a molybdenum dialkyldithiocarbamate (MoDTC) additive, specifically diisotridecylamine molybdate. The use of this formulation can aid the user in predicting the maximum applied load and the maximum operating temperature of the lubricant using color change technology. This formulation also improves the yellow metal protection, extreme pressure (EP) performance, and reduce component wear compared to a baseline lubricant formulated without the MoDTC additive. In other embodiments, the formulation may be used in drive systems in internal combustion (IC) engines, hybrid and electric vehicles, and industrial equipment (e.g., stationary engines, fracking pumps, wind turbines).

In one embodiment, a lubricant formulation for use in an electric or hybrid vehicle includes a base oil, a gear oil additive, and a molybdenum amine complex, such as dialkyldithiocarbamate additive. The molybdenum amine complex may be present in an amount of between 0.1 (w/w) % and about 1.0 (w/w) %. The base oil may be selected from the group including an oil classified by the American Petroleum Institute as a group I oil, a group II oil, a group III oil, a group IV oil, a group V oil, or combinations thereof. In one embodiment, the base oil may be about 50 (w/w) % to about 99.9 (w/w) % of the lubricant formulation.

The gear oil additives may further include viscosity modifiers, antifoaming agents, additive packages, antioxidant agents, antiwear agents, extreme pressure agents, detergents, dispersants, anti-rust agents, friction modifiers, corrosion inhibitors and combinations thereof. The gear oil additive may be present in an amount of about 0.01 (w/w) % and about 20 (w/w) % of the formulation.

The lubricant formulation may cause improved electric motor protection when voltage is applied to an electrode in the presence of the formulation comprising the molybdenum dialkyldithiocarbamate additive as compared to a fluid lacking the molybdenum dialkyldithiocarbamate additive. The formulation may also maintain electrical resistance slope as compared to a fluid lacking the molybdenum dialkyldithiocarbamate additive. It may also have improved protective properties for copper surfaces or exhibit a color change indicating the contact load, temperature, time, or viscosity of the formulation.

In another embodiment, a method of evaluating the electrical characteristics or performance of a transmission system suitable for use in an electric or hybrid vehicle is provided. The method may include the steps of: providing a transmission body including the transmission components, wherein the transmission body and components are suitable for use in an electric or hybrid vehicle; providing a fresh lubricant formulation, i.e. an unused or untreated formulation, including a base oil suitable for use in an electric vehicle; a first additive; and a second additive, wherein the second additive comprises diisotridecylamine molybdate in an amount of about 0.5 (w/w) %.

The method may further include directly contacting at least one transmission component with the fresh lubricant formulation under a set of conditions to form a used lubricant formulation; removing at least a portion of the used lubricant formulation from the transmission system and assigning a color for the used lubricant formulation; matching the color of the used lubricant formulation with a substantially similar color assigned to a control lubricant formulation created under a substantially similar set of conditions to obtain a set of matched colors; and determining the electrical characteristic of the transmission system based on the set matched colors.

In one embodiment, the set of conditions used to evaluate the used lubricant formulation include determining the load placed on the transmission system, the temperature at which the transmission system operates, the time that the transmission system operates, and the viscosity of the fresh lubricant formulation.

BRIEF DESCRIPTIONS OF DRAWINGS

Figure 9:
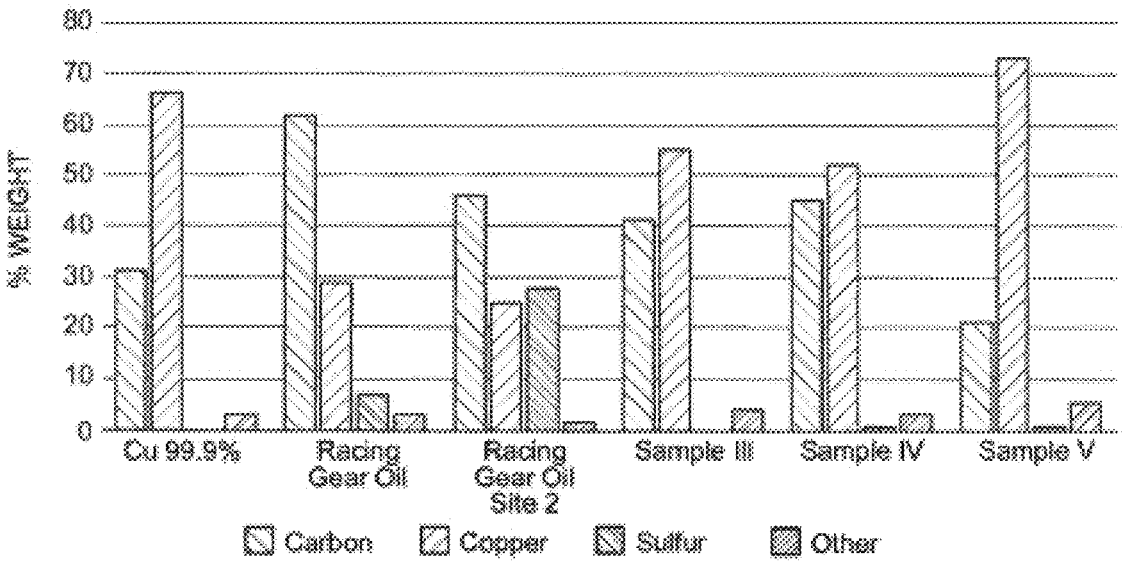
Figure 10:
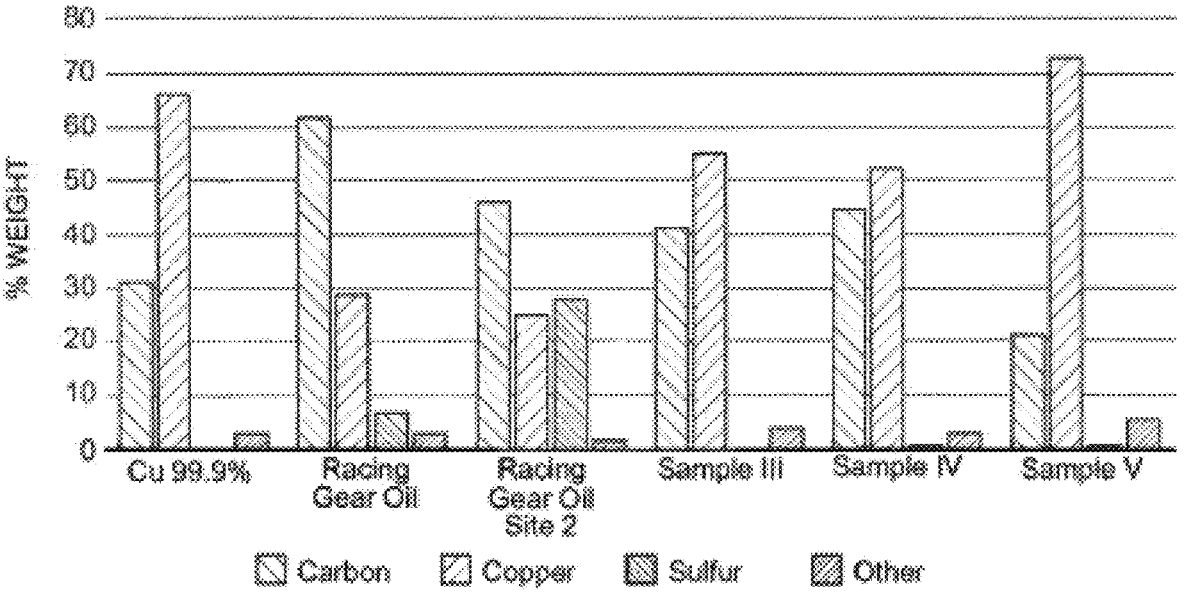
Figure 11:
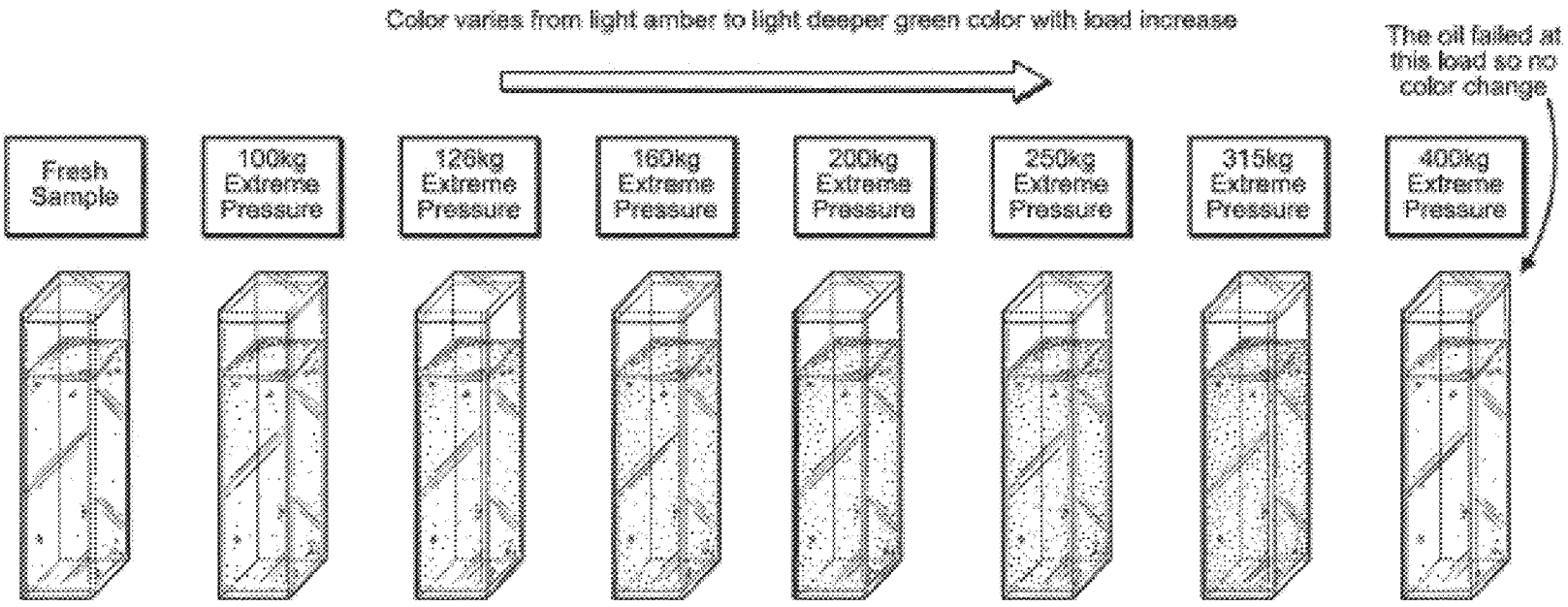
Figure 12:
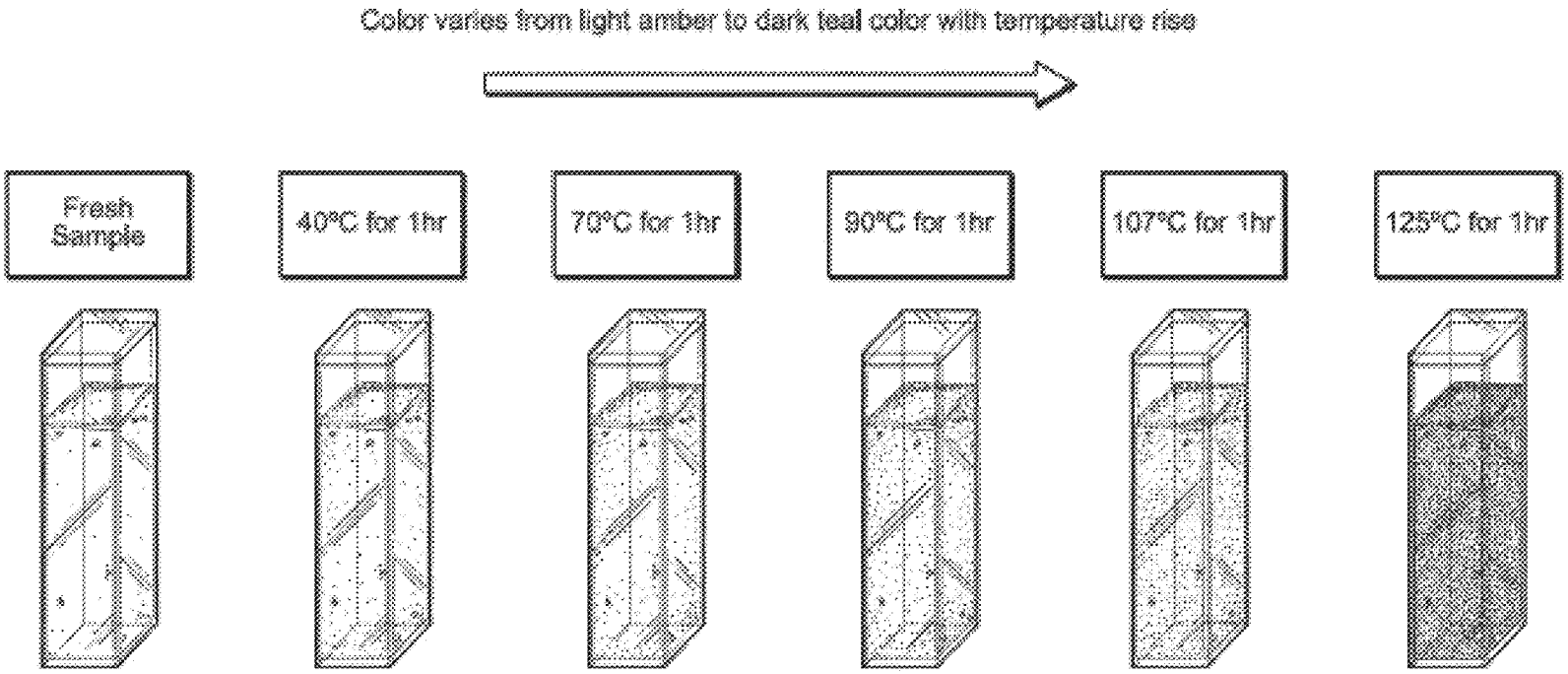
Figure 13:
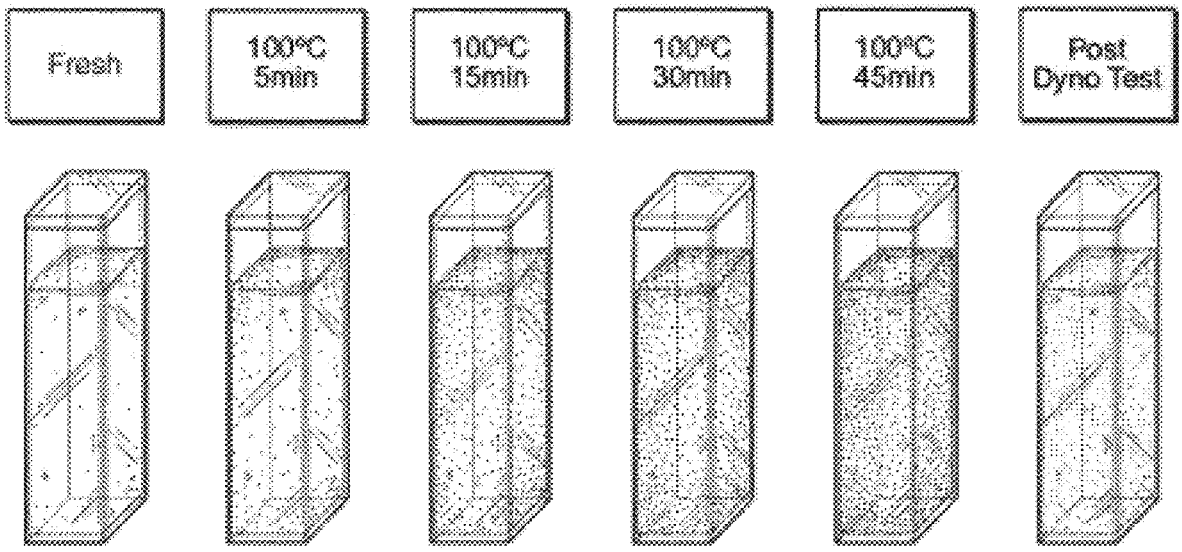
Figure 14:
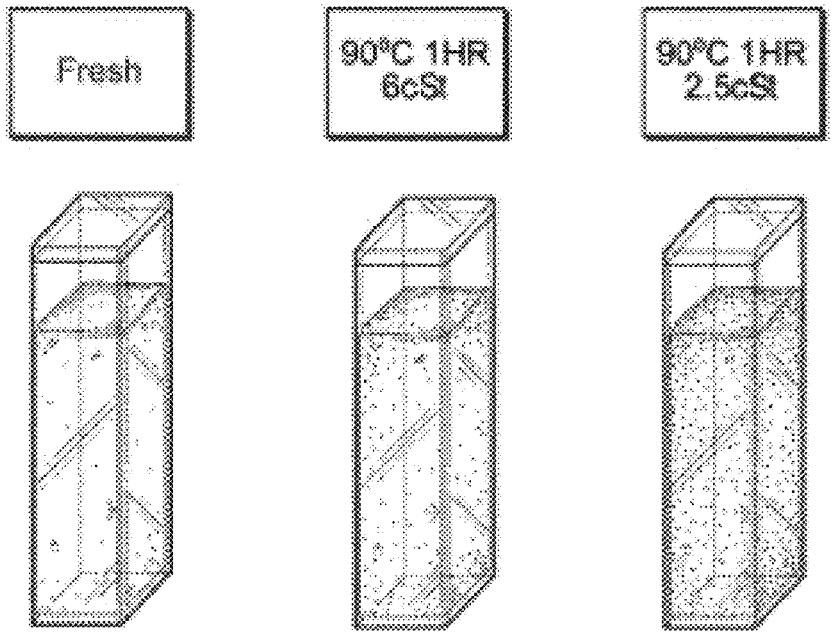
Figure 15:
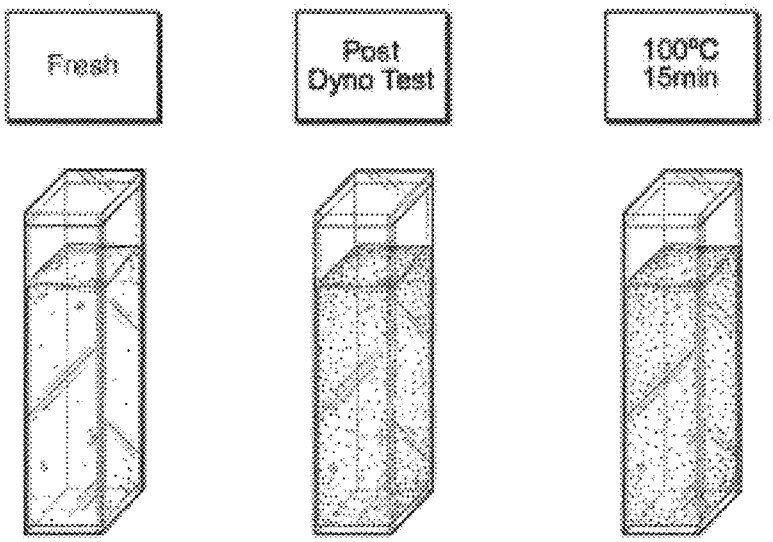

FIGS. 9 and 10 are charts showing the relative amounts of carbon, copper and sulfur present in copper wires that are untreated and treated with various lubricants for 20 and 80 hours, respectively;

FIG. 11 depicts the color change effect of an increased load on a lubricant including a MoDTC additive;

FIG. 12 depicts the color change effect of temperature on a lubricant including a MoDTC additive;

FIG. 13 depicts the color change effect of a control group lubricant including a MoDTC additive that is subjected to 100° C. for from 5 to 45 minutes and a comparative sample of the same lubricant subjected to dyno testing for 15 minutes;

FIG. 14 depicts the color change effect of viscosity on a lubricant including a MoDTC additive; and FIG. 15 depicts the consistent color change of a control group lubricant including a MoDTC additive that is subjected to 100° C. for 15 minutes and the same lubricant subjected to dyno testing for the same amount of time.

Figure 16:
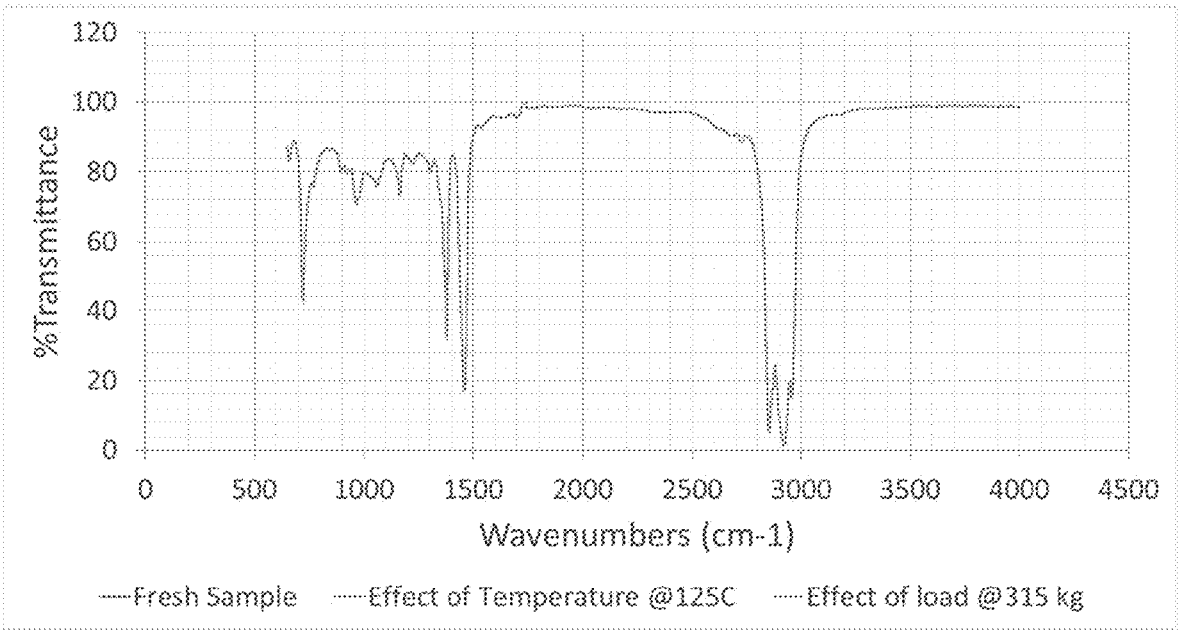

FIG. 16 shows results of an oxidation test performed to verify if any degradation happened due to the color change.

Figure 17:
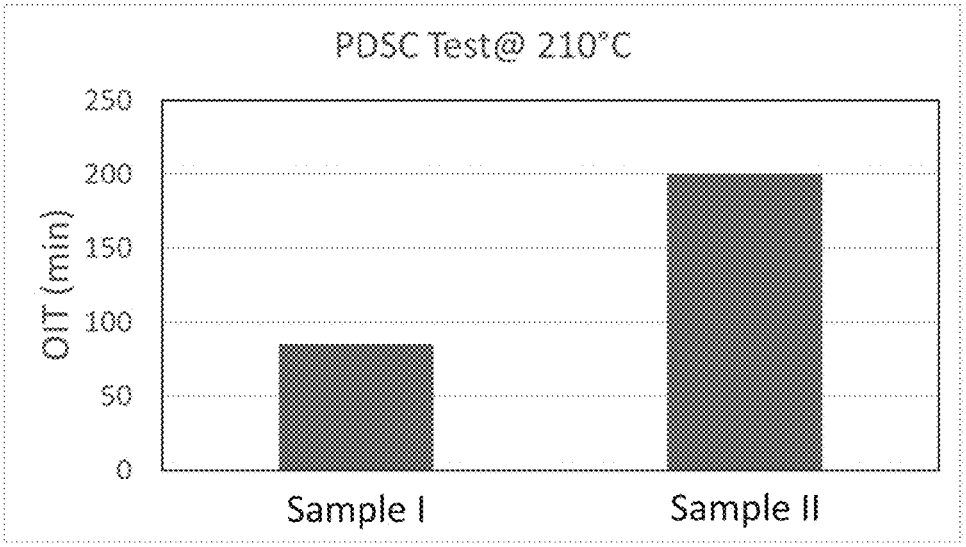

FIG. 17 shows results of CECL-85-T-99 test performed to evaluate the oxidation induction time (OIT) of Sample I against Sample II using a Pressure Differential Scanning calorimetry (PDSC).

Figure 18:
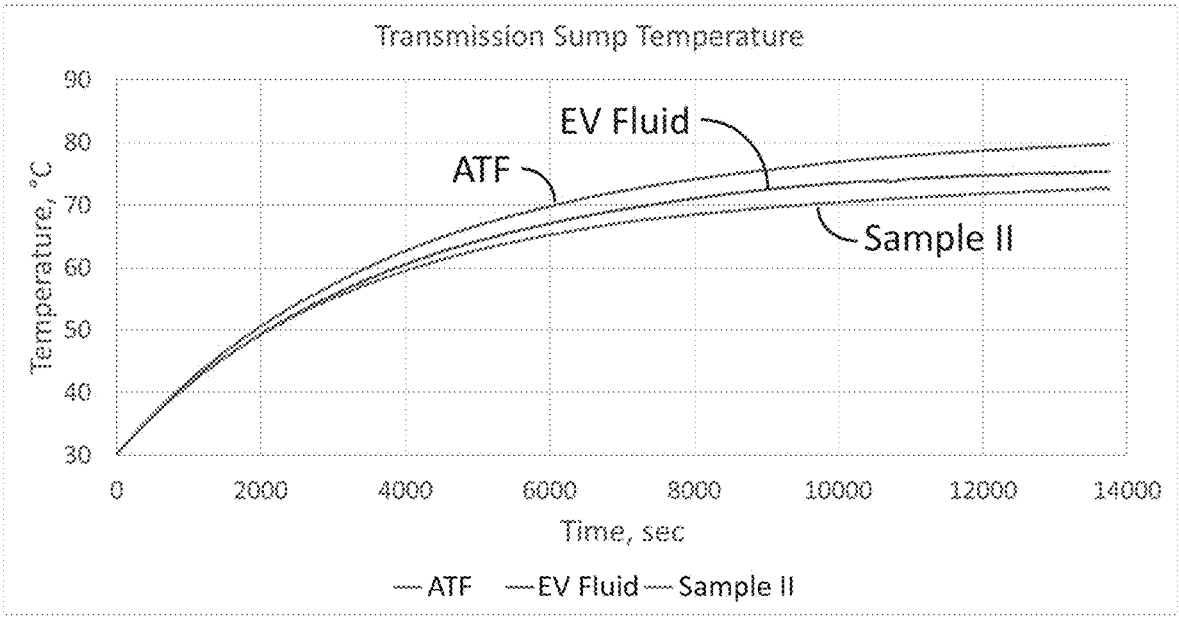

FIG. 18 shows electric vehicle transmission test results of an automatic transmission fluid (ATF), an electric vehicle fluid, and Sample II.

DETAILED DESCRIPTION

In one embodiment, a lubricant formulation for use in an electric or hybrid vehicle includes a base oil, a gear oil additive, and a molybdenum dialkyldithiocarbamate additive. Specifically, it has been surprisingly found that adding diisotridecylamine molybdate to a base oil provides unexpected protective characteristics for electric or hybrid vehicle transmissions, as well as to provide users with diagnostic and design tools for electric vehicle transmissions and engines that they did not previously have.

The base oil may be any oil classified by the American Petroleum Institute as a group I oil, a group II oil, a group III oil, a group IV oil, a group V oil, or combinations thereof. In one embodiment, the base oil may be a Group III mineral oil present in an amount of about 50 (w/w) % to about 99.9 (w/w) % of the lubricant formulation.

The additives suitable for use in the formulation may include viscosity modifiers, antifoaming agents, additive packages, antioxidant agents, antiwear agents, extreme pressure agents, detergents, dispersants, anti-rust agents, friction modifiers, corrosion inhibitors, gear oil additives, and combinations thereof, and may be present in an amount of about 0.01 (w/w) % and about 20 (w/w) % of the formulation.

In one embodiment, the additives may be selected from gear oil additives including, but not limited to, Afton Hitec 3491LV, Hitec 3491A, Hitec 363, Hitec 3080, Hitec 3460, Hitec 355, Hitec 35701 or Lubrizol A2140A, Lubrizol A2042, Lubrizol LZ 9001N, Lubrizol A6043, Lubrizol A2000, Lubrizol E5201, Lubrizol E4006 and combinations thereof. Particularly suitable transmission additives have a Sulphur base and provide protection in extreme pressure situations.

Finally, it has been found that not all MoDTC additives produce the beneficial results found by combining the base oil with a gear oil additive and a molybdenum amine complex, such as diisotridecylamine molybdate. Specifically, in one embodiment, diisotridecylamine molybdate, the general chemical structure for which is shown below:

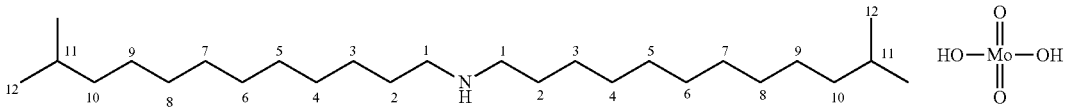

diisotridecylamine molybdate may be present in the composition in an amount of about 0.01 (w/w) % to about 20.0 (w/w) %, in another embodiment, from about 0.1 (w/w) % to about 1.0 (w/w) %, and in yet another embodiment, about 0.5 (w/w) %. Suitable molybdenum amine complex additives include, but are not limited to diisotridecylamine molybdate, commercially available from ADEKA Corp. as SAKURA-LUBE S710.

It has further been found that the combination of a gear oil additive with a molybdenum amine complex is critical for the beneficial synergies disclosed herein. To be free from doubt, MoDTC, including the term "MoDTC additives," as used hereafter shall refer to molybdenum amine complex additives, and specifically diisotrdecylamine molybdate, in the examples.

Definitions

A "fully formulated lubricant" is defined as a combination of base oils (group I, II, III, IV, V), viscosity modifiers and additives where the solution is miscible, clear and stable.

"Drive systems" can be transmissions, axles, transaxles, and industrial gearboxes.

Acronyms include, but are not limited to: MoDTC: Molybdenum Dialkyldithiocarbamate; EP: Extreme Pressure; ASTM: American Society for Testing and Materials; E3CT: Electric Conductivity Copper Corrosion Test; SEM: Scanning Electron Microscope; EDS: Energy Dispersive X-Ray Spectroscopy; BL: Boundary Lubrication; HFRR: High Frequency Reciprocating Rig; EV: Electric Vehicle; and IC: Internal Combustion.

EXAMPLES

Samples were prepared according to the following specifications in Table 1.

TABLE 1

| | Sample I | Sample II | Sample III | Sample IV | Sample V | Racing Gear Oil |
|---|---|---|---|---|---|---|
| Mineral (Organic) Base Oil | 86.7 | 86.2 | Commercially available automatic transmission fluid w/out MoDTC | Commercially available electric vehicle transmission fluid w/out MoDTC | 71.5 | 0 |
| Synthetic base oils | 0 | 0 | | | 15 | 74.2 |
| Hydrocarbon synthetic polymer viscosity modifier | 0 | 0 | | | 0 | 12.5 |
| Gear oil additives | 12.8 | 12.8 | | | 13 | 13.3 |
| MoDTC Additive | 0 | 0.5 | | | 0.5 | 0 |

The samples were then tested and compared, as detailed below.

Effect on Electrical Properties

Dielectric Breakdown

The addition of an MoDTC additive was surprisingly found to lessen the dielectric breakdown or electrical breakdown of the base oil. Specifically, as the oil (electrical insulator) becomes electrically conductive when the voltage applied across electrodes exceeds the known oil breakdown voltage, the sample containing MoDTC additive results in a higher residual electrical value, thus indicating a lower dielectric breakdown of the fluid. The less the oil experiences dielectric breakdown, the greater the potential for electric motor protection.

The dielectric breakdown of Samples I and II were tested according to ASTM standards D887-02 and D1816 using a Megger OTS60PB to detect the breakdown voltage for each system. The dielectric breakdown of fresh base oil and fresh copper electrodes was compared to the dielectric breakdown of baked fluid with baked electrodes, baked fluid and fresh electrodes, and fresh fluid and based electrodes. The baked oil and electrodes were used to simulate typical wear conditions for both the fluids and the electrodes. The fluid was baked by exposing the fresh fluid to 125° C. for an hour, while the electrodes were baked by submerging half of the electrode in fresh fluid and exposing it to 125° C. for an hour.

TABLE 2

| Electrode coating test (unit: kV) | | | | |
|---|---|---|---|---|
| | Fresh fluid and electrodes | Baked fluid and electrodes | Baked fluid and fresh electrodes | Fresh fluid and baked electrodes |
| Sample I | 50.9 | 40.3 | 39.1 | 40.4 |
| Sample II | 52.1 | 45.2 | 44.6 | 47.6 |

As shown in Table 2, Sample II, which contains the MoDTC additive, enhances the base oil performance and maintains higher dielectric strength compared to Sample I in all test scenarios.

Test for Copper Corrosion

Oil performance was also evaluated using an electric conductivity copper corrosion test (E3CT). Using E3CT, a copper wire's electrical resistance is evaluated for varying test times, while keeping the temperature (130° C. to about 160°), current (1 mA), and copper wire diameter (70 micron 99.999% pure) constant. The tests were conducted by submerging the copper wire in a glass tube containing the sample lubricants. The tube and the wire were also submerged in a silicon oil bath to control the sump temperature. And, the electric current (1 mA) and resistance were measured using a Keithley Meter.

Figure 1:
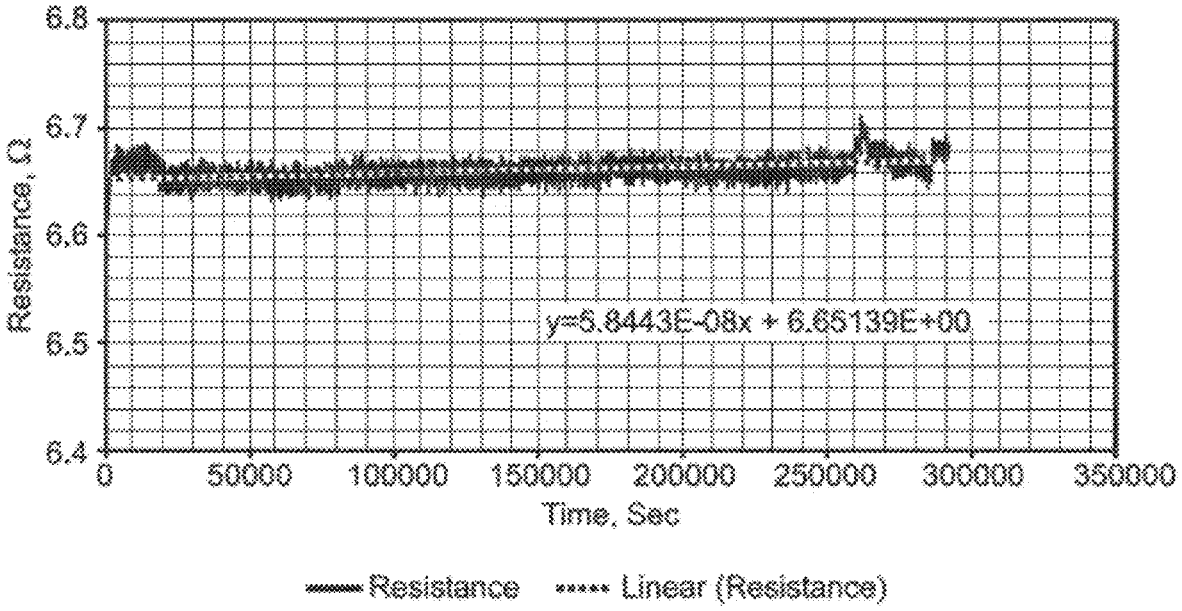
FIG. 1 illustrates the results of a copper wire corrosion test for Sample III.
Figure 2:
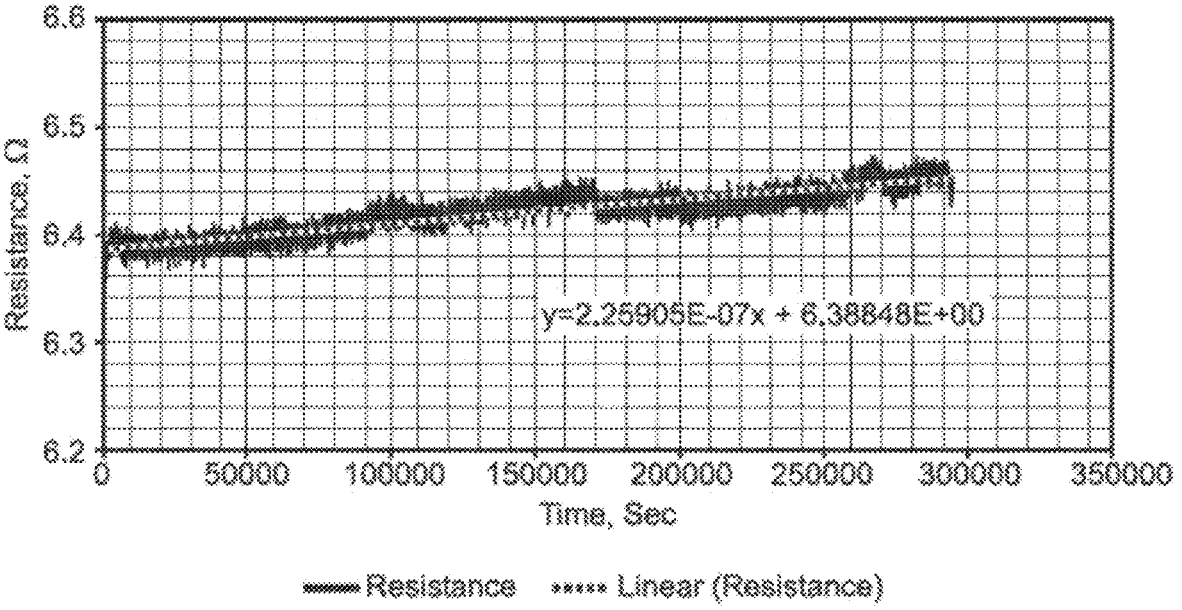
FIG. 2 illustrates the results of a copper wire corrosion test for Sample IV.
Figure 3:
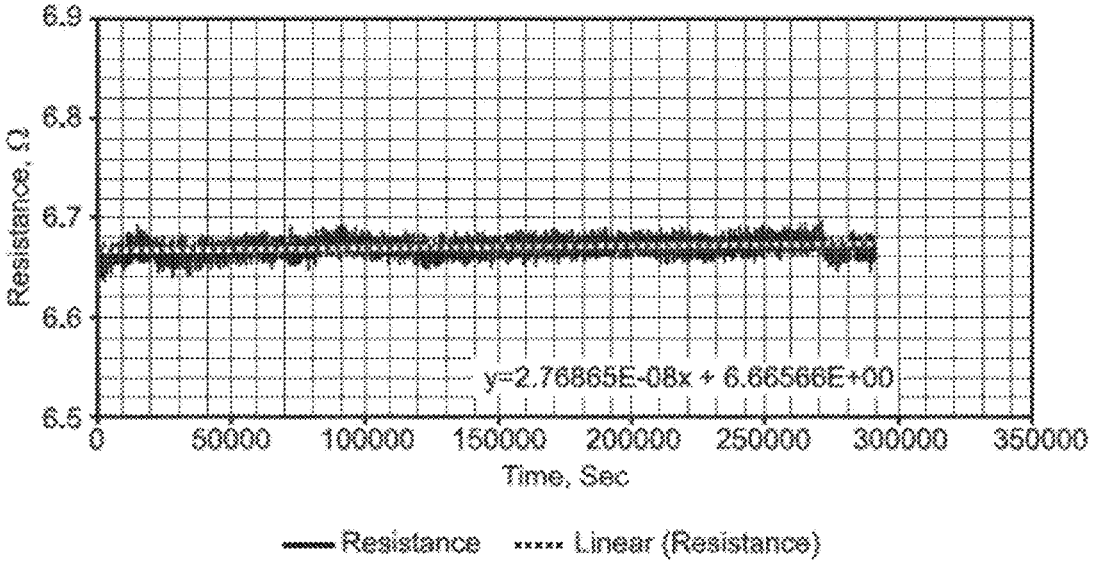
FIG. 3 illustrates the results of a copper wire corrosion test for Sample V.

As shown in FIGS. 1, 2, and 3, the electrical resistance performance of three samples was evaluated. FIGS. 1 and 2 include the performance data for Samples III and IV, widely commercially available automatic transmission fluids formulated without a MoDTC additive, while FIG. 3 includes the performance data for Sample V, an oil formulation including the MoDTC additive. Specifically, Sample III is a commercially available oil widely used in hybrid cars and Sample IV is a commercially available oil developed specifically for EV applications. All three test scenarios were conducted over an 80 hour test window.

As shown in FIGS. 1, 2, and 3, the addition of the MoDTC additive to the base oil, matched for viscosity, produced an electrical resistance slope that was almost flat, compared to fully formulated commercial lubricants from Samples III and IV. Specifically, it was found that the slope produced by Sample III was about 5.844e-8; Sample IV about 2.259e-7; and Sample V was about 2.768e-8.

Evaluation of a Molybdenum Chemical Film

Figure 4:
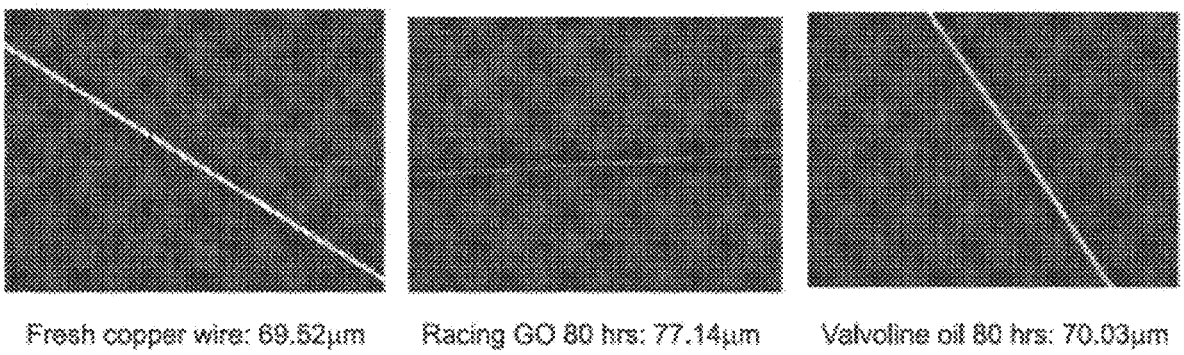
FIG. 4 illustrates the resulting diameters of copper wires treated with different lubricant formulations.

FIG. 4 depicts the variation in diameter of copper wire used in the analysis: fresh copper wire with a diameter of 69.52 μm, copper wire subjected to a racing grade gear oil commercially available from Valvoline (Racing gear oil) for 80 hrs with a diameter of 77.14 μm; and a copper wire subjected to the base oil with the MoDTC additive (Sample V) with a diameter of 70.03 μm. Without being bound by theory, it is hypothesized that additives in the oils react with the copper wire and form deposits. However, the base oil with MoDTC showed a very small increase in the wire diameter, compared to commercially available Racing gear oil, which likely contributes to the protective effect described below with regard to FIGS. 5-8.

Figure 5:
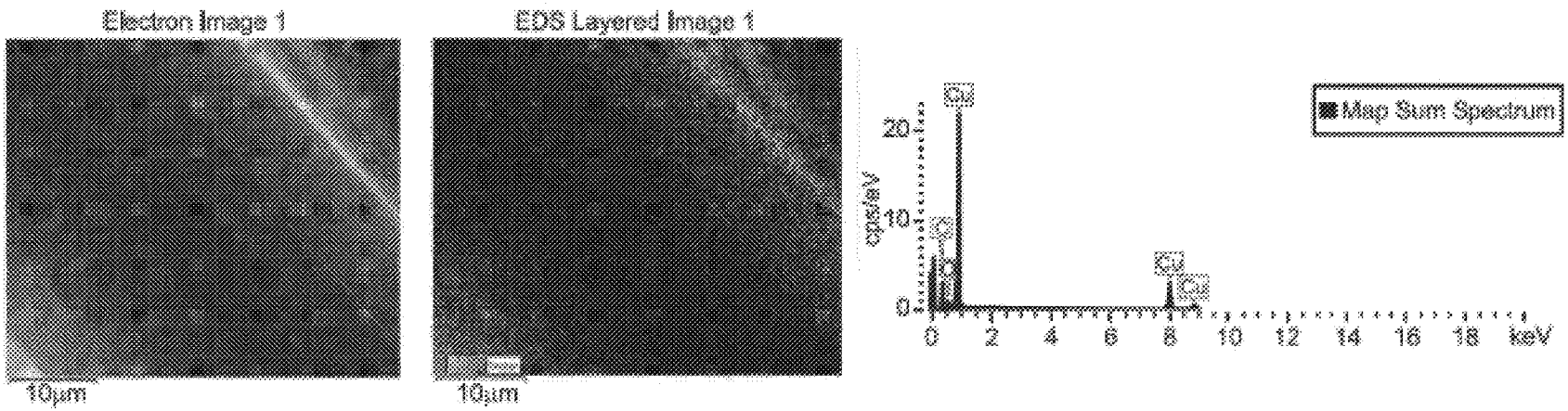
FIG. 5 illustrates the SEM data resulting from an analysis of fresh copper wire.
Figure 6:
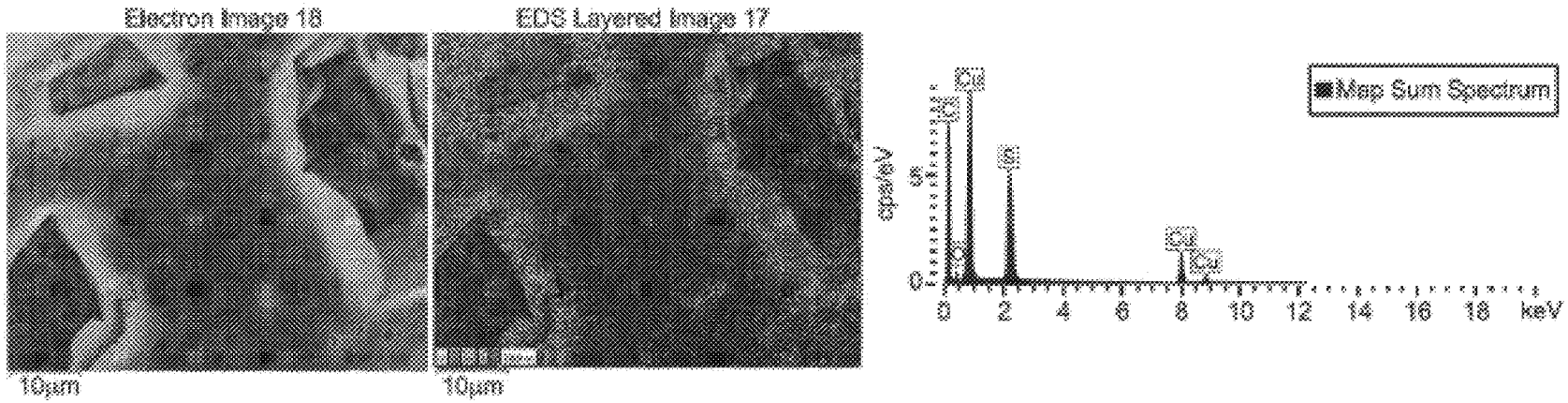
FIG. 6 illustrates the SEM data resulting from an analysis of copper wire treated with a Racing gear oil lubricant.
Figure 7:
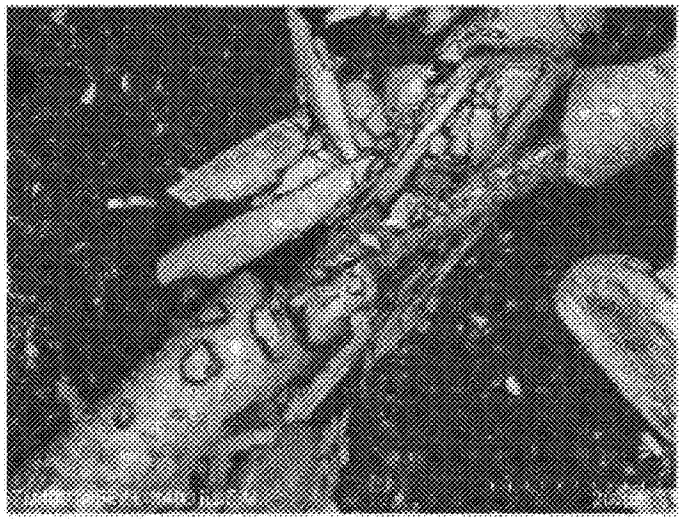
FIG. 7 is a microscopic image of a copper wire exposed to Racing gear oil lubricant for 80 hours.
Figure 8:
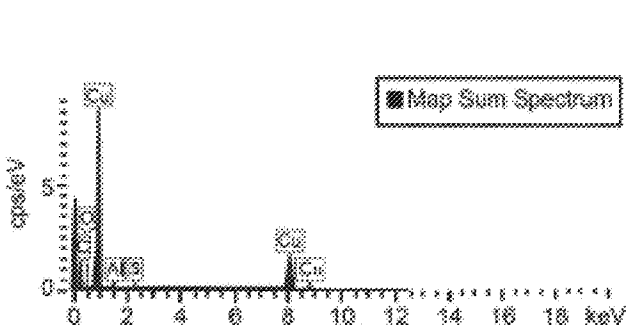
FIG. 8 illustrates the SEM data resulting from an analysis of copper wire treated with a lubricant including MoDTC additive.
Figure 8:
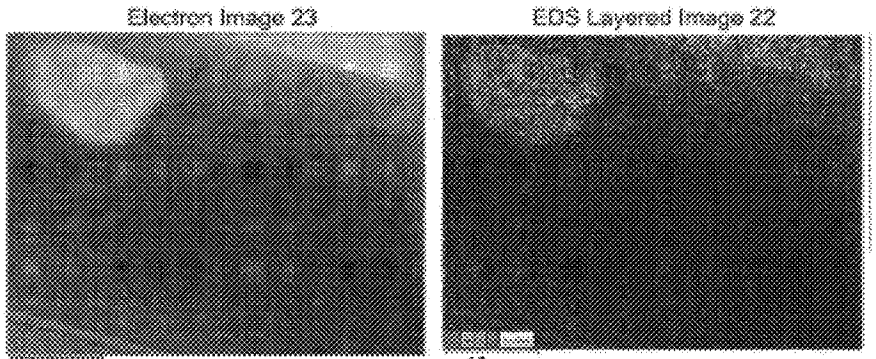

As shown in FIGS. 5, 6, 7, and 8, SEM data was acquired for the fresh copper wire, copper wire treated with Racing gear oil, and copper wire treated with a base oil having the MoDTC additive. As shown in FIG. 5, the untreated surface of the wire is smooth and clean with copper as the biggest peak. As shown in FIGS. 6 and 7, the Racing gear oil corroded the copper wire into many pieces. FIG. 8 shows the SEM data for the base oil having the MoDTC additive. As can be seen from the images, the surface is still smooth and clean after 80 hrs at 130° C.

In addition, it was discovered that a protective film is likely formed around the cooper wire by subjecting the wire to a base oil including the MoDTC additive. Using the SEM analysis of the copper wire treated with the base oil with the MoDTC additive, as shown in FIG. 8, it is hypothesized that the protective film included Molybdenum Disulphide ($MoS_2$).

FIGS. 9 and 10 depict comparative graphs for E3CT test results, where three main elements (carbon, copper, and sulfur) were measured. Energy Dispersive X-Ray Spectroscopy (EDS), a chemical microanalysis technique, was used in conjunction with SEM to evaluate the fresh copper, Racing gear oil measurement #1, Racing gear oil measurement #2, Sample III, Sample IV, and Sample V (as defined above). The Racing gear oil samples, as well as Samples III and IV, show reduction in copper and increase in carbon, compared to Sample V, which further indicates a protective effect on the copper wire when using the base oil formulated with the MoDTC additive.

Load, Temperature, Viscosity and Time Effect

In addition to reducing the dielectric breakdown of the oil and decreasing the degradation of metal components, the lubricant including the MoDTC additive can aid in allowing transmission and vehicle manufacturers to predict and analyze the sump temperature and the highest contact load exhibited by the transmissions and motors of electric vehicles based on the color variation in the lubricant. Therefore, the novel lubricants are useful for improving theoretical and modeling work to predict contact conditions and heat transfer properties of the vehicle systems more accurately.

Using the novel lubricant including the MoDTC additive, Sample VII with a viscosity of about 6 cSt, a user is able to analyze the load on the system based on the color change of the lubricant. Using the ASTM D2783 4 ball EP test, the additive reaction in the contact at different loads is evaluated by increasing the applied pressure from 0 to about 400 kg over time. As shown in FIG. 11, the color of the oil changes from light amber to a deeper green color as the load increases. It should be noted that the oil failed the testing at 400 kg of pressure, so no color change was detected.

Moreover, a user can use the novel lubricants to evaluate temperature conditions inside vehicle systems based on the color of the resulting oil. FIG. 12 shows the effect of temperature on color of the novel lubricant. The color change of the oil was found to differ from the load effect, as the color change was more dramatic. As shown, as the temperature is increased from 40° C. to 125° C., the color changes from a light amber to a dark green or blue/green color.

The oil including the MoDTC additive, made according to Sample V, as also tested in an external dynamometer testing facility and compared against the results of the controlled lab environment. For the dyno testing, the sump temperature reached about 100° C. with a very low load and a similar test time of about an hour. As shown in FIG. 13, the oil was tested at between 90° C. and 107° C. and the color matched to an oil subjected to a HFRR test at 100° C. for 15 mins, which indicates that a user may be able to match the color of the oil resulting from their own dyno testing with control samples to determine the load and the temperature at which their system performs. It should also be noted that the lubricant formulation was different in FIG. 13 (Sample V) than in FIGS. 11 and 12 (Sample VII), which indicates that different additive ingredients may be used with this MoDTC formulation to achieve similar benefits.

It was also determined that the fluid viscosity plays important role in activating the MoDTC additive. As shown in FIG. 14, similar formulations having different viscosities may behave differently in pure sliding contact conditions due to the formation of molybdenum disulphide ($MoS_2$). Specifically, three oil samples were prepared as shown below and subjected to 90° C. for about an hour.

TABLE 3

| | Sample VI | Sample VII |
|---|---|---|
| Synthetic base oils | 87.5 | 82.5 |
| Polymethacrylate Viscosity Modifier | 0 | 5.0 |
| Axle Oil Additives (Lubrizol A2042) | 12.5 | 12.5 |
| MoDTC Additive | 0.5 | 0.5 |

Sample VII, with a viscosity of 6 centistokes, had a different color (light amber) than did the formulation with a viscosity of 2.5 centistokes (light green), Sample VI, when compared to the untreated fresh lubricant of the same viscosity. Therefore, the color change of the lubricant may be used as an indicator of the viscosities of the various oils used.

FIG. 15 illustrates the effect of time on a base oil having the MoDTC additive made according to Sample VII. As shown in FIG. 15, over time (from 5 to 45 minutes) the oil changes from a light amber to a dark green color, when subjected to a temperature of about 100° C. By comparing the color post dyno test oil to the color of the oils tested under controlled conditions, a user can determine that the system tested in the dyno testing was tested for about 15 minutes.

Extreme pressure, wear and copper corrosion improvements were also evaluated, as shown in Table 4. The evaluation of these characteristics informs the effect the oil may have for extreme pressure protection.

TABLE 4

| | Sample I | Sample II (with MoDTC) |
|---|---|---|
| Last non-seizure load (kg) | 63 | 80 |
| Weld point load (kg) | 200 | 250 |
| Load wear Index (LWI) | 30.2 ± 1.3 | 35.4 ± 1.7 |

As shown in Table 4, the oil containing the MoDTC additive (Sample II) helps to lower the resulting loads evaluated according to the 4 ball EP test (ASTM D2783), allowing the user to protect contacting surfaces better. The last non-seizure load indicates when the metal to metal contact happened (63 v. 80, respectively). The additive also improved the 4 ball wear test results, as shown in Table 5.

TABLE 5

| | Sample I | Sample II |
|---|---|---|
| Avg Four ball wear area ($\mu m^2$) | 396,986 | 143,714 |
| Avg Four ball wear dia (μm) | 700.6 ± 76 | 410.3 ± 25 |

For the EV drive system fluid, protection of yellow metals like copper is very important while lubricating moving components. The use of a MoDTC additive also shows improved copper corrosion test results at 4 hrs at about 150° C. The rating of Sample II for the ASTM D130 test was 1A (light orange, almost the same as a freshly polished strip) compared to 1B (dark orange) of Sample I.

The lubricants described herein have been found to improve electrical properties including dielectric breakdown, electrical conductivity, and E3CT copper wire protection. In addition, the lubricants protect yellow metals and gear and bearing contacts, while showing the severity of the application conditions using color change indications. The lubricants described retain special additive protection but solve traditional corrosion issues by protecting electric and hybrid vehicle transmissions.

These findings confirm that the oil life can be increased in electric and hybrid vehicles where the oil is used to take away the generated heat from the motor. Also, OEMs can benefit from the color change phenomenon to predict operating conditions that will help improving heat transfer and drive system durability.

FIG. 16 shows results of an oxidation test performed to verify if any degradation happened due to the color change. Fourier Transform Infrared Spectroscopy (FTIR) is a good tool to check any oxidation happening due to different test conditions. As shown in the FTIR plot of FIG. 16, three different FTIR curves (e.g., curves for fresh sample, sample subjected to use under 125° C., and sample subjected to use under 315 kg) are overlapping, indicating no oxidation happened during these test conditions.

FIG. 17 shows results of CECL-85-T-99 test performed to evaluate the oxidation induction time (OIT) of Sample I against Sample II using a Pressure Differential Scanning calorimetry (PDSC). The PDSC test is performed at 210° C. at a pressure of 0.69 MPa in the presence of air. There is a significant improvement in the oxidation stability (oil life) where MoDTC helps improving OIT by 1.35 times.

FIG. 18 shows electric vehicle transmission test results of an automatic transmission fluid (ATF), an electric vehicle fluid, and Sample II. This test is set up to measure the performances of different EV fluids in the market compared to Sample II. The test was performed at constant speed and torque (3000 rpm and 50 lb. ft/67.8 Nm) with average of at least 3 tests for each fluid. Sample II shows the best performance and the temperature reduction is 8.5° C. after the equilibrium is achieved.

Table 6 shows test results on transmission test efficiency gains of different fluids. The power saving of Sample II is significant compared to a conventional EV fluid and ATF (e.g., ATF has a well established benchmark fluid for EV transmission applications). The final constant temperature value of Sample II is 8.5° C. lower than that of the ATF and 3.5° C. lower than that of the EV Fluid. Sample II shows 25 Watts (W) saving compared to that of the ATF and 11 W saving compared to that of the EV fluid. The transmission efficiency gain of Sample II is about 3.9% higher than that of the ATF and about 1.7% higher than that of the EV fluid. These results show that the specially designed EV fluid as disclosed herein include effective ingredients configured to improve efficiency, durability, and oil life.

TABLE 6

| | Final Constant | Advantages of Sample II | | |
|---|---|---|---|---|
| | Temperature, ° C. | Difference, ° C. | Power saving, W | Efficiency gain, % |
| ATF | 81.0 | 8.5 | 25 | 3.9 |
| EV Fluid | 76.0 | 3.5 | 11 | 1.7 |
| Sample II | 72.5 | — | — | — |

Certain embodiments have been described in the form of examples. It is impossible to depict every potential application. Thus, while the embodiments are described in considerable detail, it is not the intention to restrict or in any way limit the scope of the appended claims to such detail, or to any particular embodiment.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When "only A or B but not both" is intended, then the term "only A or B but not both" will be employed. Thus, use of the term "or" herein is the inclusive, and not the exclusive use. As used in the specification and the claims, the singular forms "a," "an," and "the" include the plural. Finally, where the term "about" is used in conjunction with a number, it is intended to include ±10% of the number. For example, "about 10" may mean from 9 to 11.

As stated above, while the present application has been illustrated by the description of embodiments, and while the embodiments have been described in considerable detail, it is not the intention to restrict or in any way limit the scope of the appended claims to such detail. Additional advantages and modifications will readily appear to those skilled in the art, having the benefit of this application. Therefore, the application, in its broader aspects, is not limited to the specific details and illustrative examples shown. Departures may be made from such details and examples without departing from the spirit or scope of the general inventive concept.

The invention claimed is:

1. A system for determining a characteristic of a transmission system comprising at least one transmission component, the system comprising:

a lubricant formulated for use in the at least one transmission component, wherein the lubricant comprises:

a base oil;

a first gear oil additive; and a second additive, wherein the second additive comprises a diisotridecylamine molybdate additive in an amount of about 0.5 (w/w) % to about 1.0 (w/w) % of the lubricant, wherein the diisotridecylamine molybdate additive causes a variation in color of the lubricant in response to use of the lubricant in the transmission system for a period of time, the variation in color is indicative of temperature, contact load, viscosity, or operation time, and the variation in color is not due to oxidation of the lubricant; and a chart depicting expected lubricant color change undergone by a lubricant of a specified viscosity when the at least one transmission component is operated under certain conditions for a certain amount of time for a characteristic, wherein the lubricant is configured to show the variation in color between a temperature window from about 40° C. up to about 125° C., and the chart depicts expected lubricant color change undergone by the lubricant when the at least one transmission component is operated under the temperature window from about 40° C. up to about 125° C., the color of the lubricant is amber at 40° C. and is blue or green at 125° C., wherein a characteristic of the at least one transmission component may be evaluated by directly contacting a transmission component comprising an electric motor with a fresh lubricant formulation, operating the at least one transmission component under a set of conditions to form a used lubricant formulation, removing at least a portion of the used lubricant formulation from the at least one transmission component, assigning a color to the used lubricant formulation, and matching the color of the used lubricant formulation to the chart.

2. The system of claim 1, wherein the lubricant is configured to improve an oxidation induction time by about 1.35 times due to the presence of the diisotridecylamine molybdate additive, wherein the oxidation induction time of the lubricant is tested using pressure differential scanning calorimetry at 210° C. and a pressure of 0.69 mega pascal in air presence.

3. The system of claim 1, wherein the lubricant is configured to reach an equilibrium temperature under a test performed at a constant torque of 3000 rpm and 67.8 Nm for at least 13000 seconds, the equilibrium temperature is reduced by about 8.5° C. as compared to an automatic transmission fluid without the diisotridecylamine molybdate additive.

4. The system of claim 1, wherein the lubricant is configured to increase a transmission efficiency by about 3.9% as compared to an automatic transmission fluid without the diisotridecylamine molybdate additive, wherein the transmission efficiency is defined as power output divided by input power.

5. A method of using a lubricant in a transmission system of an electric or hybrid vehicle, the method comprising the steps of:

providing the transmission system comprising transmission components, wherein the transmission components are suitable for use in an electric or hybrid vehicle;

providing a fresh lubricant comprising:

a base oil;

a first gear oil additive; and a second additive, wherein the second additive comprises a diisotridecylamine molybdate additive, in an amount of about 0.5 wt % to about 1.0 wt % of the fresh lubricant, wherein the diisotridecylamine molybdate additive causes a variation in color of the fresh lubricant in response to use of the fresh lubricant in the transmission system for a period of time, the variation in color is indicative of temperature, contact load, viscosity, or operation time, and the the variation in color is not due to oxidation of the fresh lubricant;

directly contacting at least one of the transmission components with the fresh lubricant;

operating the transmission components under a set of conditions to form a used lubricant;

removing at least a portion of the used lubricant from the transmission system and assigning a color for the used lubricant;

matching the color of the used lubricant to a chart with a substantially similar color assigned to a control lubricant created under a substantially similar set of conditions to obtain a set of matched colors; and determining a characteristic of the transmission system selected from a load placed on the transmission system, a temperature at which the transmission system operates, a time that the transmission system operates, and a viscosity of the used lubricant based on the set of matched colors.

6. The method of claim 5, comprising providing the fresh lubricant to improve an oxidation induction time by about 1.35 times due to the presence of the diisotridecylamine molybdate additive, wherein the oxidation induction time of the lubricant is tested using pressure differential scanning calorimetry at 210° C. and a pressure of 0.69 mega pascal in air presence.

7. The method of claim 5, comprising operating the transmission components under a temperature window from about 40° C. up to about 125° C.

8. The method of claim 5, comprising providing the fresh lubricant to reduce an equilibrium temperature of the fresh lubricant by about 8.5° C., under a test performed at a constant torque of 3000 rpm and 67.8 Nm for at least 13000 seconds, as compared to an automatic transmission fluid without the diisotridecylamine molybdate additive.

9. The method of claim 5, comprising providing the fresh lubricant to increase a transmission efficiency by about 3.9% as compared to an automatic transmission fluid without the diisotridecylamine molybdate additive, wherein the transmission efficiency is defined as power output divided by input power.

10. The method of claim 8, wherein the equilibrium temperature is about 72.5° C.

11. The method of claim 5, wherein the base oil is a Group III oil present in an amount from about 50 (w/w) % to about 99.9 (w/w) %.

12. The method of claim 5, wherein the first gear oil additive further comprises viscosity modifiers, antifoaming agents, additive packages, antioxidant agents, antiwear agents, extreme pressure agents, detergents, dispersants, anti-rust agents, friction modifiers, corrosion inhibitors, or a combination thereof.

13. The method of claim 5, wherein the first gear oil additive is present in an amount of about 0.01 (w/w) % to about 20 (w/w) %.

14. The method of claim 5, wherein the second additive is present in an amount of about 0.5 (w/w) %.

15. The system of claim 3, wherein the equilibrium temperature is about 72.5° C.

16. The system of claim 1, wherein the base oil comprises a group I oil, a group II oil, a group III oil, a group IV oil, a group V oil, or a combination thereof.

17. The system of claim 1, wherein the base oil is a Group III oil present in an amount from about 50 (w/w) % to about 99.9 (w/w) %.

18. The system of claim 1, wherein the first gear oil additive further comprises viscosity modifiers, antifoaming agents, additive packages, antioxidant agents, antiwear agents, extreme pressure agents, detergents, dispersants, anti-rust agents, friction modifiers, corrosion inhibitors, or a combination thereof.

19. The system of claim 1, wherein the first gear oil additive is present in an amount of about 0.01 (w/w) % to about 20 (w/w) %.

20. The system of claim 1, wherein the second additive is present in an amount of about 0.5 (w/w) %.

* * * * *